US005904402A

United States Patent [19]

Sabo

[11] Patent Number: 5,904,402

[45] Date of Patent: May 18, 1999

[54] ROLLABLE LOUNGER

[75] Inventor: Irving Sabo, Easton, Conn.

[73] Assignee: Ethan Allen, Inc., Danbury, Conn.

[21] Appl. No.: 09/024,465

[22] Filed: Feb. 17, 1998

[51] Int. Cl.[6] ..... B60N 2/02

[52] U.S. Cl. ..... 297/354.13; 297/377

[58] Field of Search ..... 297/354.13, 354.12, 297/377; 5/37.1, 38, 39

[56] References Cited

U.S. PATENT DOCUMENTS

| | | | |
|---|---|---|---|
| D. 259,679 | 6/1981 | Sroub | D6/38 |
| D. 283,178 | 4/1986 | Cronk | D6/361 |
| D. 326,584 | 6/1992 | van de Ven | D6/361 |
| D. 336,998 | 7/1993 | Grosfillex | D6/361 |
| 3,737,926 | 6/1973 | Hermanson | 297/377 X |
| 4,264,102 | 4/1981 | Sroub | 297/377 |
| 4,521,054 | 6/1985 | Deconinck | 297/357 |
| 4,522,446 | 6/1985 | Sheridan | 297/377 |
| 5,681,089 | 10/1997 | Lin | 297/377 X |

FOREIGN PATENT DOCUMENTS

| | | | |
|---|---|---|---|
| 8005212 | 3/1981 | Netherlands | 297/354.13 |
| 8807827 | 10/1988 | WIPO | 297/377 |

*Primary Examiner*—Laurie K. Cranmer

*Attorney, Agent, or Firm*—Schweitzer Cornman Gross & Bondell LLP

[57] ABSTRACT

A rollable lounger which comprises an undercarriage having a top end, and a bottom end resting on a surface on which the rollable lounger is disposed, a frame attached for support over the undercarriage, the frame having a body support portion disposed adjacent to the bottom end, and a backrest portion disposed adjacent to the top end, and incrementally articulated from the body support portion between an upright position, and a lowered position in which the backrest portion is a horizontal extension of the body support portion, two wheels attached spaced from each other to the top end, a backrest support attached to and articulated from the top end, between a forward position for supporting the backrest portion in an upright position and a rearward lowered position at which the backrest portion is in its horizontal position, and the backrest portion is supported from the top surface of the wheels and frictionally arresting them from rotation, and a clearance is provided between the backrest support and the backrest portion.

4 Claims, 3 Drawing Sheets

FIG. 2
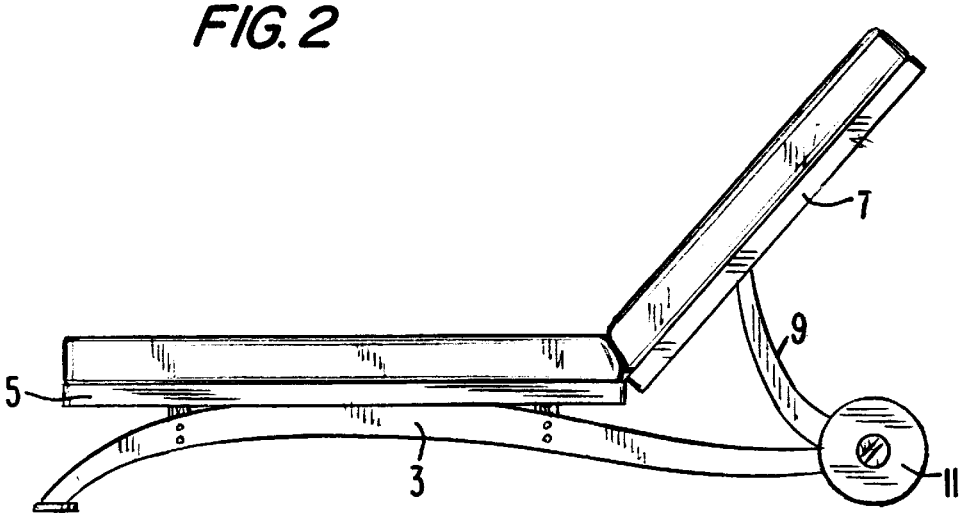
FIG. 3
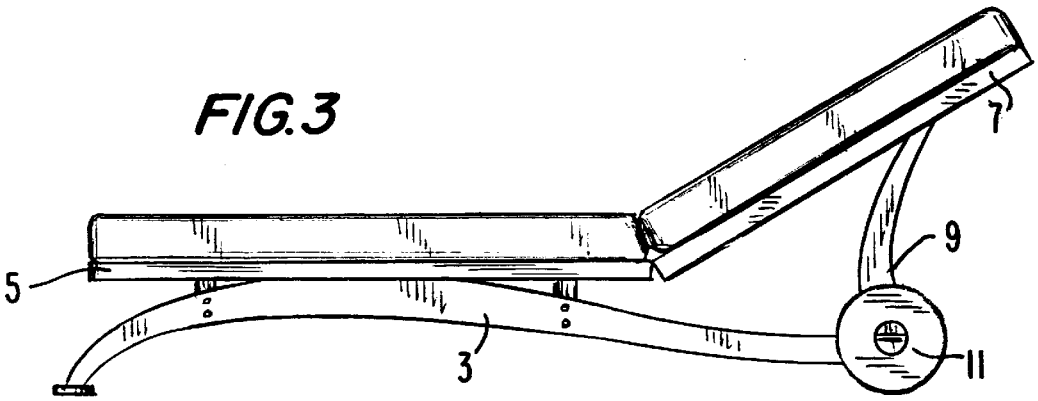
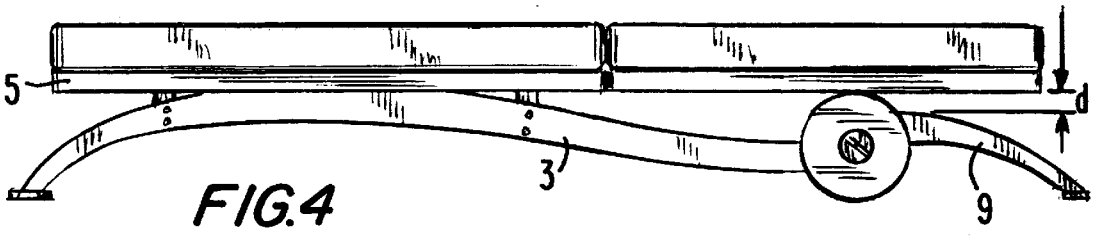
FIG. 4

ROLLABLE LOUNGER

FIELD OF THE INVENTION

The present invention relates to a rollable lounger with an adjustable backrest.

BACKGROUND

Rollable loungers are generally provided with at least a pair of wheels for facilitating their being moved around. A common problem with all known rollable lounger designs is that the wheels are not arrested from rotation when the lounger is being used and, therefore, the wheels, with the attached lounger may roll to a greater or lesser degree, depending on the slope and unevenness of the terrain, without permitting the lounger and a person thereon to remain in a securely steady position.

SUMMARY OF THE INVENTION

It is an object of the present invention to provide a rollable lounger of simple design, in which arresting of the wheels is enabled in a simple and inexpensive manner to secure the lounger in place when a body is disposed thereon in a prone position.

Accordingly, the present invention is a rollable lounger which comprises an undercarriage having a top end, and a bottom end resting on a surface on which a rollable lounger is disposed, a frame attached for support over the undercarriage, the frame having a body support portion disposed adjacent to the bottom end and the back rest portion disposed adjacent to the top end, and incrementally articulated from the body support portion between an upright position and a lowered position in which the backrest portion is a horizontal extension of the body support portion, two wheels attached spaced from each other to the top end, a backrest support attached to and articulated from the top end, between a forward position for supporting the backrest portion in an upright position and the rearward lowered position in which the backrest portion is in its horizontal position, and the backrest position is supported from the top surface of the wheels and frictionally arresting them from rotation, and a clearance is provided between the backrest support and the backrest portion.

BRIEF DESCRIPTION OF THE DRAWING

The invention is disclosed in greater detail, with reference being had to the enclosed drawing, wherein:

FIG. 2 is a side view showing the backrest portion in an upright position;

FIG. 3 is a side view showing the backrest end portion in an intermediate position;

FIG. 4 is a side view showing the backrest portion in a horizontal position;

DETAILED DESCRIPTION

Figure 1:
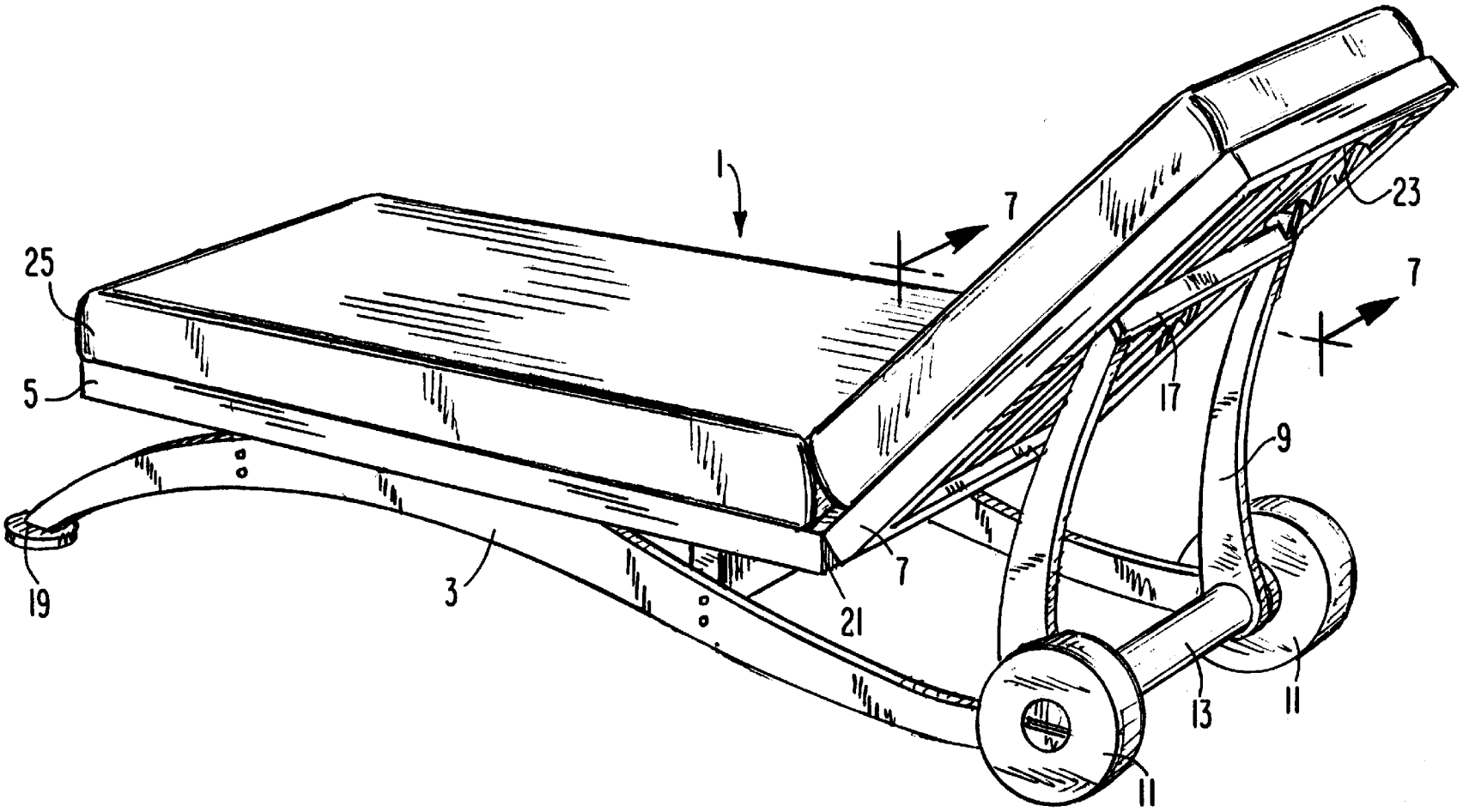
FIG. 1 is a perspective view of the rollable lounger.
Figure 5:
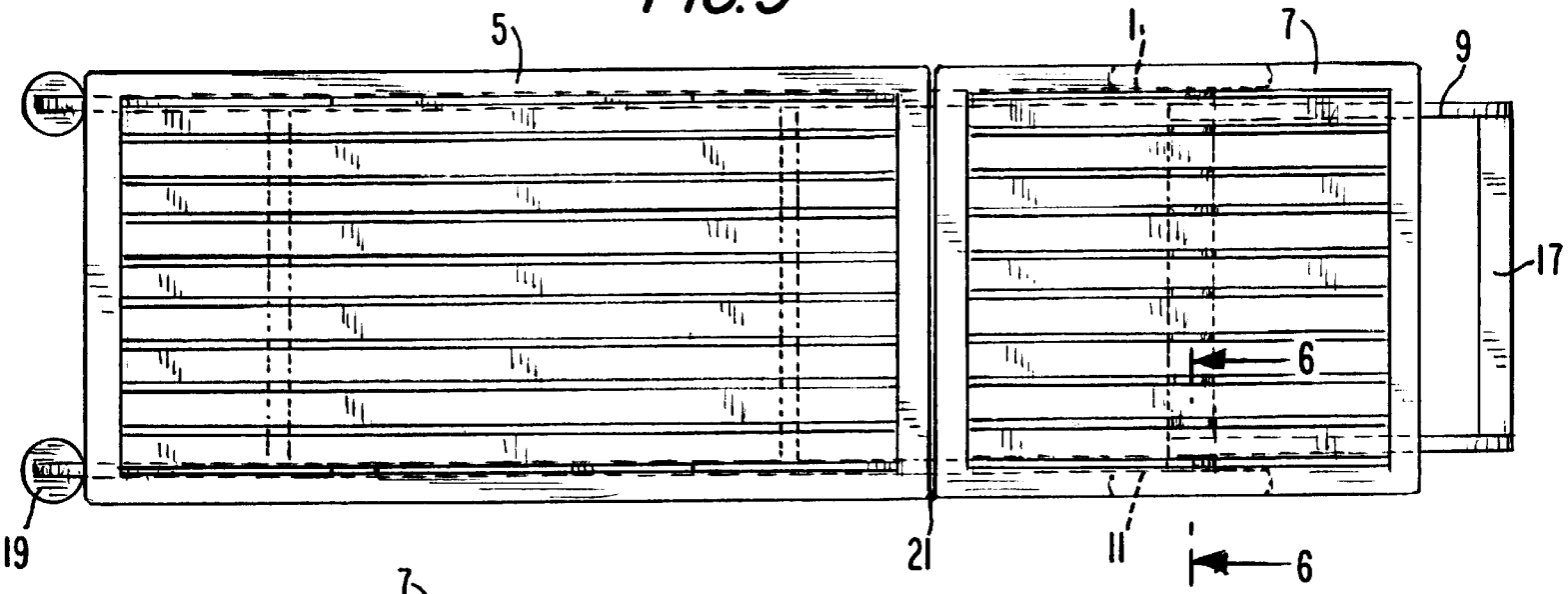
FIG. 5 is a top view with the mattress removed.
Figure 7:
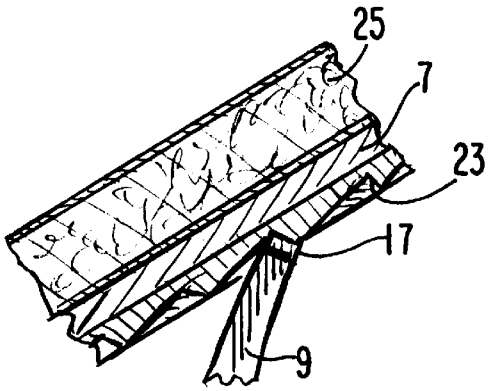
FIG. 7 is a cross-sectional view taken along the lines 7—7 of FIG. 1.

As shown in greater detail in FIG. 1 the rollable lounger 1 of the present invention is supported over an undercarriage 3 to which a frame is attached. More specifically, a body support portion 5 of the frame is attached to the undercarriage and a hinge 21 attaches a backrest portion 7 articulated from the body support portion 5 of the frame.

The backrest portion 7 can be articulated between a variety of positions, as best shown in FIGS. 2–4, wherein its position can be varied from an upright position as shown in FIG. 2 to a completely horizontal position shown in FIG. 4 when a person can lie entirely prone on the lounger.

The various articulated positions of the backrest portion can be fixed by a backrest support 9 articulated from an axle 13 having wheels 11, 11 mounted at each end. The backrest support can be attached to ratchet-like indentations 23 on the back of the backrest portion for maintaining it in its various articulated positions.

When the backrest portion is in the position shown in FIG. 4, it is a horizontal extension of the body support portion 5 of the frame. In that prone position shown in FIG. 4 the backrest support is completed lowered at the top end of the lounger, whereby its cross bar 17 rests entirely on the ground. In that lowered position of the backrest portion 7 the frame of the backrest portion frictionally engages the top surface of the wheels 11 and arrests them from rotation. If a person disports on the lounger, the weight of that person presses the backrest portion 7 with a sufficient force onto the rim of the wheel 11 so that it is sufficiently arrested from rotation. At the bottom end of the lounger undercarriage 3 supporting pads 19 support the lounger on the floor, and the bottom surfaces of the wheels 11 which rest on the ground support the top end of the lounger on the floor.

Suitably the mattress 25 is split into two parts in the area of the hinge 21, with the covering fabric of the mattress joining the two parts of the mattress together.

Figure 6:
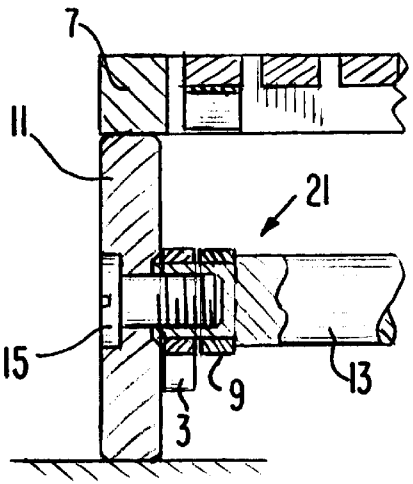
FIG. 6 is a cross-sectional view taken along the lines 6—6 of the FIG. 5.

FIG. 6 shows the manner in which the wheels 11 are attached to the axle 13 by a screw 15 to provide a rotational attachment for the wheel, an articulation to the backrest portion from the axle 13, and a termination for the upper end of the undercarriage 3, all by means of the connection 21.

I claim:

1. A rollable lounger which comprises (i) an undercarriage having
  (a) a top end, and
  (b) a bottom end resting on a surface on which the rollable lounger is disposed, (ii) a frame attached for support over said undercarriage, the frame having
  (a) a body support portion disposed adjacent to said bottom end, and
  (b) a backrest portion disposed adjacent to said top end, and incrementally articulated from said body support portion between an upright position, and a lowered position in which said backrest portion is a horizontal extension of said body support portion, (iii) two wheels attached spaced from each other to said top end, (iv) a backrest support attached to and articulated from said top end, between a forward position for supporting said backrest portion in an upright position and a rearward lowered position at which said backrest portion is in said horizontal position, and said backrest portion is supported from the top surface of said wheels and frictionally arresting them from rotation, and a clearance is provided between said backrest support and said backrest portion.

2. The rollable lounger of claim 1, further comprising means for attaching said backrest support at preselected locations to said backrest portion for fixing said backrest portion in a preselected articulated position.

3. The rollable lounger of claim 1, wherein said top end is resting on the surface on which the rollable lounger is disposed.

4. The rollable lounger of claim 2, wherein said top end is resting on the surface on which the rollable lounger is disposed.

* * * * *